US008590255B2

(12) United States Patent
Daudet et al.

(10) Patent No.: US 8,590,255 B2
(45) Date of Patent: Nov. 26, 2013

(54) BRIDGING CONNECTOR

(76) Inventors: Larry Randall Daudet, Brentwood, CA (US); Jin-Jie Lin, Livermore, CA (US)

( * ) Notice: Subject to any disclaimer, the term of this patent is extended or adjusted under 35 U.S.C. 154(b) by 0 days.

(21) Appl. No.: 13/281,429

(22) Filed: Oct. 26, 2011

(65) Prior Publication Data

US 2013/0104490 A1 May 2, 2013

(51) Int. Cl.
*E04B 2/60* (2006.01)

(52) U.S. Cl.
USPC ..... 52/655.1; 52/243; 52/317; 52/349; 52/712

(58) Field of Classification Search
USPC ..... 52/243, 317, 349, 481.1, 655.1, 696, 52/702, 712
See application file for complete search history.

(56) References Cited

U.S. PATENT DOCUMENTS

| | | | | | |
|---|---|---|---|---|---|
| 719,191 | A | | 1/1903 | Collins | |
| 1,101,745 | A | | 6/1914 | Jones | |
| 1,346,426 | A | | 7/1920 | Sherbner | |
| 2,365,501 | A | * | 12/1944 | Walstrom | 403/174 |
| 2,873,828 | A | | 2/1959 | Zitomer | |
| 2,918,995 | A | | 12/1959 | Kruger | |
| 3,083,794 | A | | 4/1963 | Stovail | |
| 3,322,447 | A | * | 5/1967 | Biggs | 403/252 |
| 3,482,369 | A | | 12/1969 | Burke | |
| 3,778,952 | A | | 12/1973 | Soucy | |
| 4,043,689 | A | | 8/1977 | Spencer | |
| 4,208,851 | A | | 6/1980 | Sauer | |
| 4,426,822 | A | | 1/1984 | Gailey | |
| 4,464,074 | A | | 8/1984 | Green | |
| 4,586,841 | A | | 5/1986 | Hunter | |
| 4,791,766 | A | | 12/1988 | Egri, II | |
| 4,840,005 | A | | 6/1989 | Cochrane | |
| 4,858,407 | A | | 8/1989 | Smolik | |
| 4,864,791 | A | | 9/1989 | Platt | |
| 4,912,894 | A | | 4/1990 | Platt | |
| 4,916,877 | A | | 4/1990 | Platt | |
| 5,189,857 | A | | 3/1993 | Herren | |
| 5,287,664 | A | | 2/1994 | Schiller | |
| 5,363,622 | A | | 11/1994 | Sauer | |
| 5,403,110 | A | * | 4/1995 | Sammann | 403/234 |
| 5,600,926 | A | | 2/1997 | Ehrlich | |
| 5,664,392 | A | * | 9/1997 | Mucha | 52/715 |
| 5,669,198 | A | | 9/1997 | Ruff | |
| 5,671,580 | A | | 9/1997 | Chou | |
| 5,682,935 | A | | 11/1997 | Bustamante | |
| 5,697,725 | A | * | 12/1997 | Ballash et al. | 403/231 |
| 5,784,850 | A | | 7/1998 | Elderson | |
| 5,876,006 | A | | 3/1999 | Sharp | |
| 5,899,041 | A | | 5/1999 | Durin | |

(Continued)

OTHER PUBLICATIONS

"Wall Bridging Detail". NuconSteel Product Catalog, 2003, front cover, table of contents, p. 34. NuconSteel., USA.

(Continued)

*Primary Examiner* — Adriana Figueroa
(74) *Attorney, Agent, or Firm* — James R. Cypher; Charles R. Cypher

(57) ABSTRACT

A building connection between a substantially vertical wall stud and a substantially horizontal bridging member, using a separate and distinct bridging connector that attaches the wall stud to the bridging member. The wall stud is typically one of several sequentially-arranged, cold-formed steel studs in the frame of a building wall. The bridging member is typically a separate cold-formed steel member that interfaces with and spans a plurality of wall studs.

28 Claims, 11 Drawing Sheets

(56) References Cited

U.S. PATENT DOCUMENTS

| | | | | |
|---|---|---|---|---|
| 5,904,023 | A * | 5/1999 | diGirolamo et al. | 52/712 |
| 5,943,838 | A | 8/1999 | Madsen | |
| 5,964,071 | A | 10/1999 | Sato | |
| 6,021,618 | A | 2/2000 | Elderson | |
| 6,164,028 | A | 12/2000 | Hughes | |
| 6,199,336 | B1 * | 3/2001 | Poliquin | 52/489.1 |
| 6,260,318 | B1 | 7/2001 | Herren | |
| 6,290,214 | B1 * | 9/2001 | DeSouza | 256/69 |
| 6,418,695 | B1 | 7/2002 | Daudet | |
| D463,575 | S | 9/2002 | Daudet | |
| 6,578,335 | B2 | 6/2003 | Poliquin | |
| 6,688,069 | B2 * | 2/2004 | Zadeh | 52/715 |
| 6,694,695 | B2 | 2/2004 | Collins | |
| 6,701,689 | B2 * | 3/2004 | diGirolamo | 52/667 |
| 6,708,460 | B1 | 3/2004 | Elderson | |
| 6,739,562 | B2 * | 5/2004 | Rice | 248/247 |
| 6,792,733 | B2 | 9/2004 | Wheeler | |
| 6,920,734 | B2 | 7/2005 | Elderson | |
| 7,017,310 | B2 | 3/2006 | Brunt | |
| 7,021,021 | B2 * | 4/2006 | Saldana | 52/696 |
| 7,104,024 | B1 * | 9/2006 | diGirolamo et al. | 52/710 |
| 7,159,369 | B2 | 1/2007 | Elderson | |
| 7,168,219 | B2 | 1/2007 | Elderson | |
| 7,174,690 | B2 * | 2/2007 | Zadeh | 52/715 |
| 7,398,621 | B2 * | 7/2008 | Banta | 52/93.1 |
| 7,503,150 | B1 * | 3/2009 | diGirolamo et al. | 52/702 |
| 7,520,100 | B1 | 4/2009 | Herrman | |
| 7,559,519 | B1 | 7/2009 | Dragic | |
| 7,596,921 | B1 * | 10/2009 | diGirolamo et al. | 52/696 |
| 7,634,889 | B1 | 12/2009 | diGirolamo et al. | |
| 7,739,850 | B2 | 6/2010 | Daudet | |
| 7,836,657 | B1 | 11/2010 | diGirolamo | |
| 8,011,160 | B2 * | 9/2011 | Rice | 52/745.09 |
| D657,891 | S | 4/2012 | Jones | |
| 8,205,402 | B1 | 6/2012 | diGirolamo | |
| 8,225,581 | B2 | 7/2012 | Strickland et al. | |
| 2002/0059773 | A1 | 5/2002 | Elderson | |
| 2003/0037494 | A1 | 2/2003 | Collins | |
| 2003/0089053 | A1 | 5/2003 | Elderson | |
| 2007/0251186 | A1 | 11/2007 | Rice | |
| 2010/0126103 | A1 * | 5/2010 | Digirolamo et al. | 52/655.1 |

OTHER PUBLICATIONS

"Double Deep-Leg Track", "Bridge Clip Installation", "BC600 & BC800 Installation", "BridgeBar", "BridgeClip", "BC600 or BC800". The Steel Network, Inc. Product Catalog, Jan. 2004, front cover, p. 11, 27, 49. Steel Network, Inc., USA.

"Bridging, Bracing & Backing: Spazzer 5400 Spacer Bar (SPZS), Bar Guard (SPBG) & Grommet (SPGR)". Clip Express Product Catalog: Clips, Connectors & Framing Hardware, Apr. 2012, p. 77. Clark Dietrich Building Systems, USA.

"Metal-Lite Products". Metal Lite website, metal-lite.net. Accessed Sep. 20, 2013, one page Metal Lite 2012, USA.

"Mantisgrip Product Catalog 2012". Catalog, 2012, 10 pages and cover. Mantisgrip 2012, USA.

* cited by examiner

BRIDGING CONNECTOR

BACKGROUND OF THE INVENTION

The present invention relates to steel stud building wall systems and especially to apparatuses for stabilizing steed studs to prevent lateral movement and torsion in such systems.

Many industrial, and a growing number of residential, buildings are constructed with steel stud wall framing for a variety of reasons. Steel framing is fireproof, does not warp, cannot be infested, and does not rot. When a wall is built with any kind of stud, wood or steel, it is generally desirable to fix sequential studs relative to each other and each against lateral movement and torsion. In wood-stud walls, a short piece of wood blocking is typically nailed to adjacent stud pairs to stabilize them. In steel-stud walls, an elongated steel bridging member is typically inserted horizontally through pre-punched openings in a series of vertical studs to keep them aligned. Steel studs have excellent columnar strength when they are straight, but a significant portion of that strength is lost if the studs are twisted. Because steel studs are particularly vulnerable to torsion, the bridging member, which is typically channel-shaped, having a horizontal web and two vertical side flanges, is made to closely fit the openings in the vertical studs in order to maximize torque resistance. In additional to mechanical torque, metal studs can twist or bend in response to the heat of a fire when the drywall sheathing, which acts as a firebreak, is destroyed. When metal studs twist or bend, they lose their weight-bearing capacity, multiplying the damage caused directly by fire.

While channel-shaped bridging members closely received in the openings can help restrain the studs from twisting, some twisting can still occur and the studs can still shift or bend parallel to the wall. A variety of sheet metal brackets, beginning with a simple right angle, have been designed to prevent this shifting or bending. The prior art brackets are all relatively labor intensive to install and their connections are all relatively weak. For example, with the simple right angle bracket, the installer places the horizontal leg of the bracket on the bridging member and the vertical leg of the bracket against the web of the wall stud. Screws are inserted through both legs to attach the bracket to the bridging member and the stud. The bracket relies on the screw connections to function, and the installer must ensure that the bracket is placed correctly. Later prior art brackets have improved on this basic connection.

The prior art also includes short bridging members that, like the wood blocking members mentioned above, span only adjacent studs and have ends tailored for fastening the wall studs, but these bridging members are relatively expensive because they use additional material to form the ends, they require a large number of fasteners, and they are necessarily of fixed length, which makes them useless if the spacing between any two studs has to be varied from the norm.

The prior art also includes elongated bridging members with a series of slots that are designed for mating with the opening in the wall stud webs, but these make relatively weak connections and also have the disadvantage that they cannot accommodate any variation in the spacing between studs.

It is an object of the present invention to provide a bracket that uses less material than prior art brackets, installs faster and more easily using fewer fasteners, and forms a connection that is stronger, resisting both lateral and torsional loads better than the prior art.

SUMMARY OF THE INVENTION

The present invention provides a connector for firmly connecting and stabilizing a building wall steel stud in concert with a bridging member. The bridging member passes through an opening in each of several studs in a section of a wall. The bridging member is designed to keep the studs in alignment along the length of the wall when it is installed through the studs.

The present invention provides a connector with edges that interlock with the web of a wall stud to provide exceptional torsional rigidity. The edges are braced by the body plates of the connector, allowing them to resist substantially higher loads than flanges adjacent to the web of the wall stud.

The present invention provides a connector with edges or similarly narrow lines that interface with the sides of the bridging members that connect wall studs, also providing exceptional torsional rigidity. These narrow interfaces are braced by flanges that intersect with the sides of the bridging members instead of being positioned alongside and parallel to the sides of the bridging members.

The interfaces with the sides of the bridging members are further reinforced by bracing the opposite ends of the flanges against the web of the wall stud, so that the diagonal flanges are trapped between the sides of the bridging members and the web of the wall stud.

The exceptional strength of the interlocking connections between the bridging connector, the bridging member and the wall stud allow the bridging connector to be firmly connected with a single fastener that attaches the body of the bridging connector to the bridging member.

For added strength, a second fastener can be used to attach the bridging connector to the wall stud.

BRIEF DESCRIPTION OF THE DRAWINGS

FIG. 33 is an upper front right perspective view of a bridging connector formed according to the present invention as it is being inserted in the elongated opening in the web of a typical cold-formed steel bridging member above a typical cold-formed steel bridging member.

DETAILED DESCRIPTION OF THE INVENTION

Figure 1:
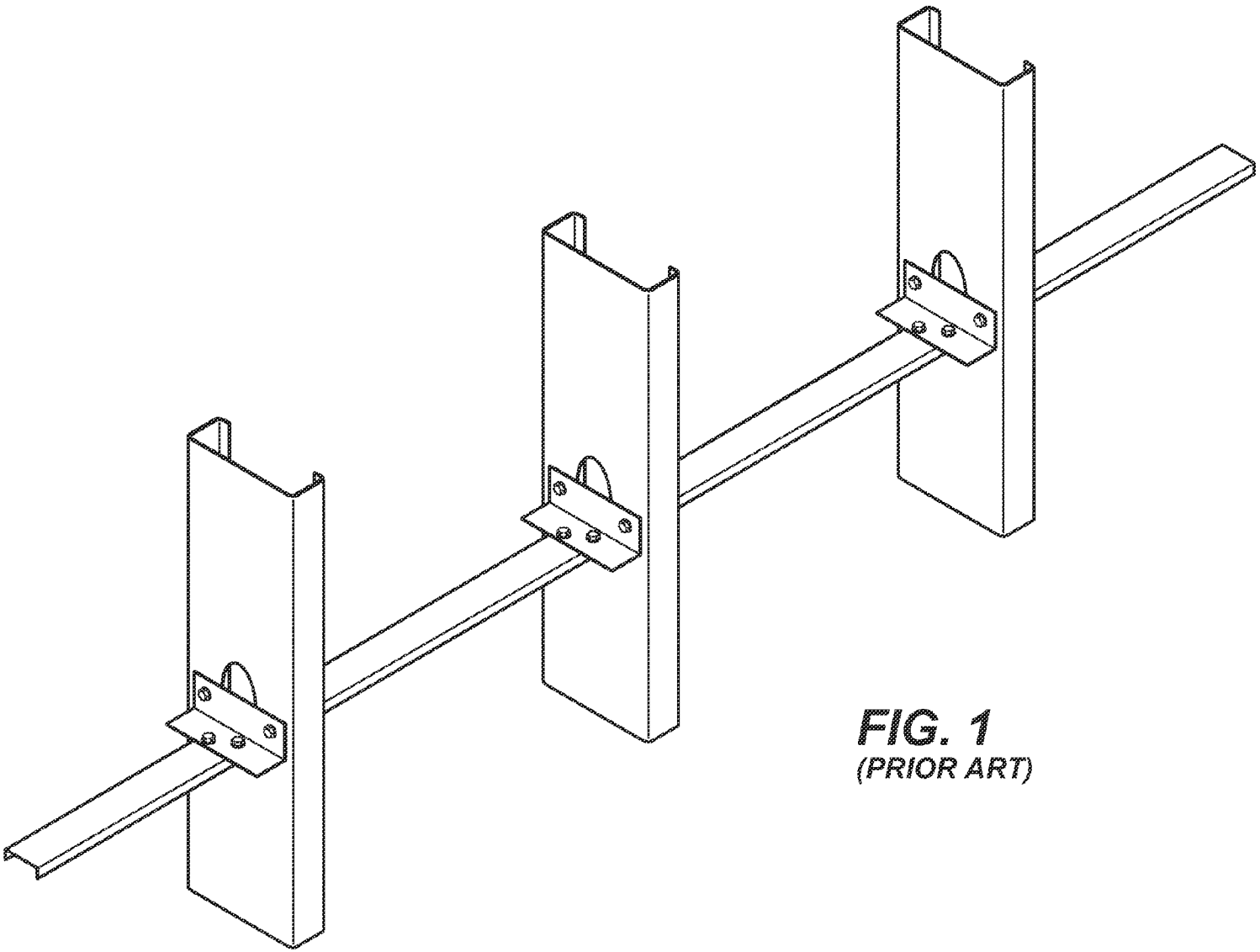
FIG. 1 (PRIOR ART)
FIG. 1 is an upper front right perspective view of a wall section with three typical cold-formed steel wall studs joined by a typical cold-formed steel channel-shaped bridging member and simple right-angle brackets, formed according to the prior art.

As shown in FIGS. 2, 4A, 4B, 12 and 16, the present invention is a building connection 1 that comprises a substantially vertical wall stud 2, a substantially horizontal bridging member 11, and a separate, distinct bridging connector 19 that attaches the wall stud 2 to the bridging member 11. The wall stud 2 is typically one of several sequentially-arranged, cold-formed steel studs 2 in the frame of a building wall. The bridging member 11 is typically a separate cold-formed steel member that interfaces with and spans a plurality of wall studs 2. A prior art connection is shown in FIG. 1.

Typically, the wall stud 2 includes a central web 3 having a first side 4 and a second side 5, an inner surface 6 and an outer surface 7, and a elongated opening 8. The central web 3 is typically rectangular and occupies a vertical plane. A first side flange 9 is integrally attached to the first side 4. A second side flange 10 is integrally attached to the second side 5. The first and second side flanges 9 and 10 are typically rectangular and occupy vertical planes that are mutually parallel and are both orthogonal to the central web 3. The central web 3 of the wall stud is typically 3.635 (3⅝), 6 or 8 inches wide, although there are wall studs 2 as narrow as 2.5 inches and as wide as 12 inches, with widths between 3.635 (3⅝) and 6 inches as well as between 6 and 12 inches. The elongated opening 8 is typically 1.5 inches wide and 3.25 inches tall. The first and second side flanges 9 and 10 are typically 1.62 (1⅝) inches wide, although there are wall studs 2 with first and second side flanges 9 and 10 that are 2 inches wide and 2.5 inches wide.

Typically, the first side flange 9 of the wall stud 2 has a third side 51 opposite and parallel to the first side 4, and the second side flange 10 of the wall stud 2 has a fourth side 52 opposite and parallel to the second side 5. The first side flange 9 has an inner surface 53 and an outer surface 54. The second side flange has an inner surface 55, which faces the inner surface 53 of the first side flange 9, and an outer surface 56. A first stiffening flange 57 is attached to the first side flange 9 along the third side 51, and a second stiffening flange 58 is attached to the second side flange 10 along the fourth side 52. The first stiffening flange 57 has a first inner edge 59 and the second stiffening flange 58 has a second inner edge 60 which faces the first inner edge 59 of the first stiffening flange. 57. The first stiffening flange 57 has an inner surface 61, which faces the inner surface 6 of the central web 3, and an outer surface 62. The second stiffening flange 58 has an inner surface 63, which also faces the inner surface 6 of the central web 3, and an outer surface 64. The wall studs 2, the bridging members 11, and the preferred bridging connector 19 are all generally channel-shaped. The bridging member 11 has a middle web 12, having first and second boundaries 13 and 14, to which boundary flanges 17 and 18 are connected. Similarly, the bridging connector 19 has web-like first and second body plates 20 and 26, to which first and second side flanges 35 and 36, and third and fourth side flanges 43 and 44 are connected.

Because the wall studs 2 and bridging members 11 are typically made from sheet metal, and the bridging connector 19 is preferably made from sheet metal, there are several major bends in all three. Typically, the first side 4 and the second side 5 of the central web 3 of the wall stud 2, not only bound the central web 3 but also are bends, as well as junctures between the central web 3 and the first and second side flanges 9 and 10 of the wall stud 2. The third and fourth sides 51 and 52 of the first and second side flanges 9 and 10 of the wall stud 2 are also bends and junctures between the first and second side flanges 9 and 10, respectively, and the first and second stiffening flanges 57 and 58. Similarly, the first and second boundaries 13 and 14 of the middle web 12 of the bridging member 11 are typically bends, as well as junctures between the middle web 12 and the first and second boundary flanges 17 and 18. Preferably, the first and second side boundaries 33 and 34 of the first body plate 20 of the bridging connector 19 are also bends, as well as junctures between the first body plate 20 and the first and second side flanges 35 and 36 of the bridging connector 19. Preferably, the third and fourth side boundaries 41 and 42 of the second body plate 26 of the bridging connector 19 are also bends, as well as junctures between the second body plate 26 and the third and fourth side flanges 43 and 44 of the bridging connector 19.

Figure 2:
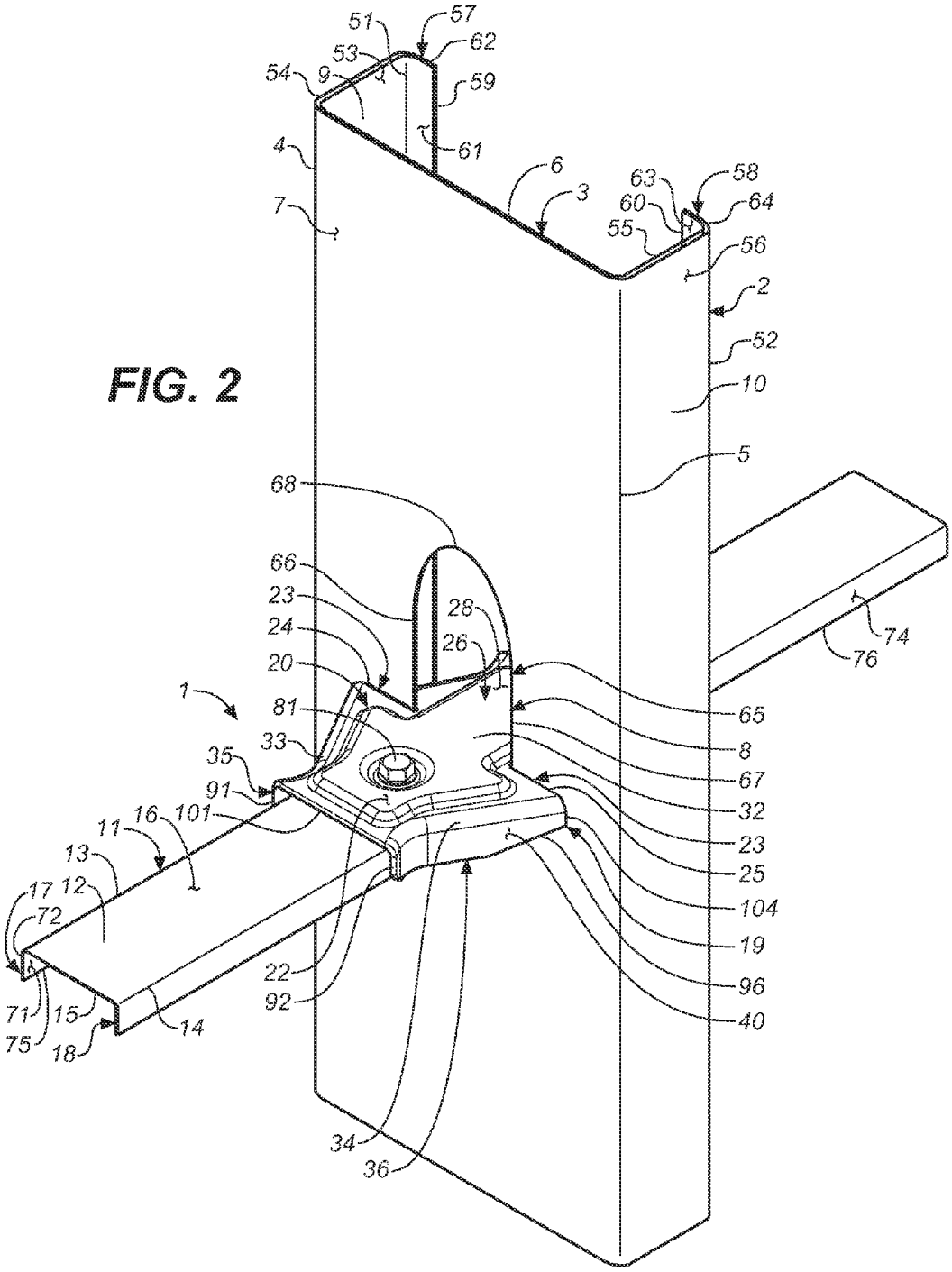
FIG. 2 is an upper front right perspective view of a connection made between a typical cold-formed steel wall stud, a typical cold-formed steel bridging member, and bridging connector formed according to the present invention.
Figures 3A, 3B, 3C:
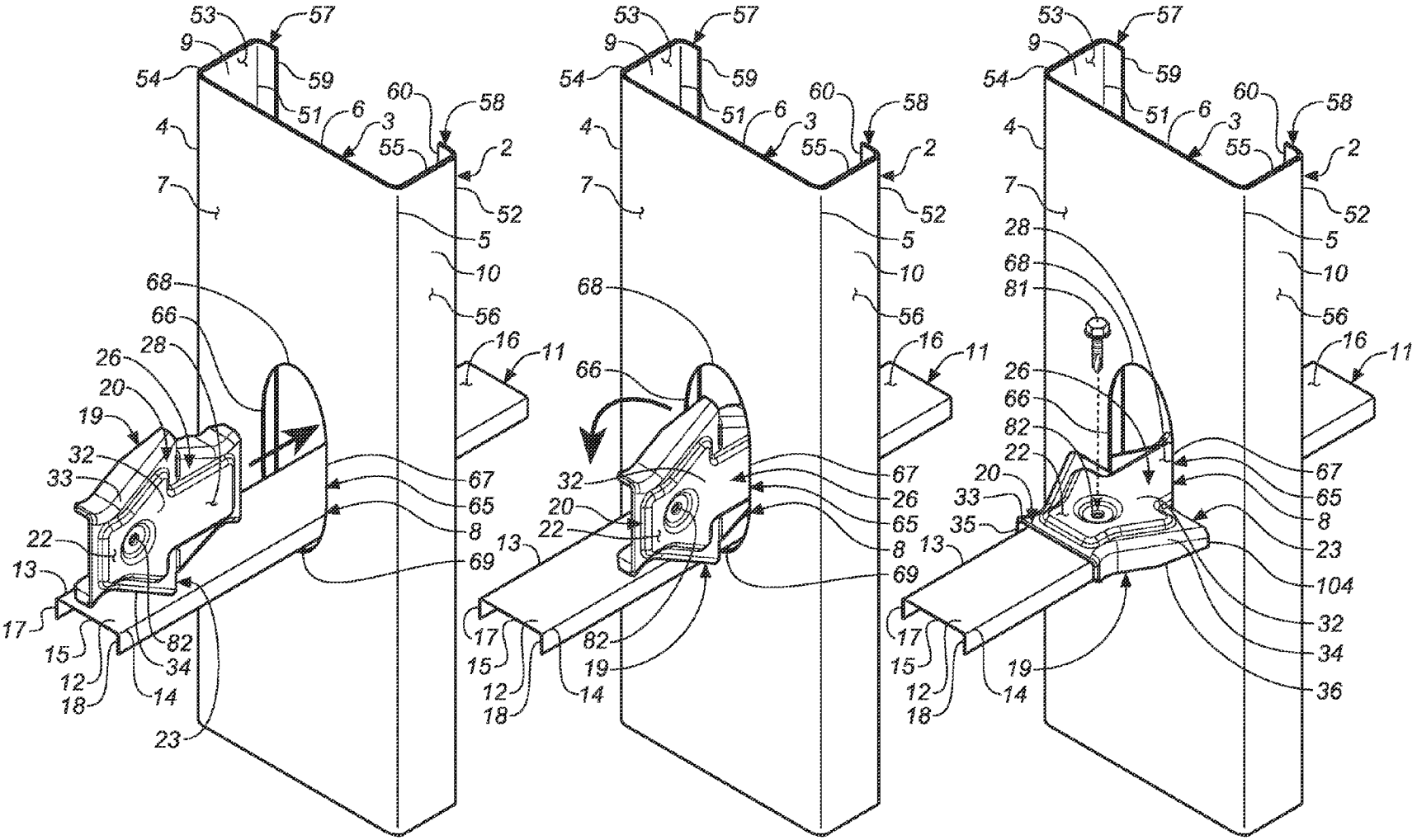
FIG. 3A is an upper front right perspective view of a bridging connector formed according to the present invention before it is inserted in the elongated opening in the web of a typical cold-formed steel bridging member above a typical cold-formed steel bridging member.
FIG. 3C is an upper front right perspective view of a bridging connector formed according to the present invention interfacing with the sides of the elongated opening in the web of a typical cold-formed steel bridging member and resting on a typical cold-formed steel bridging member before being attached to the bridging member with a separate fastener.

As shown in FIG. 2, the sheet metal of the first and second body plates 20 and 26 of the bridging connector 11 is preferably embossed in order to stiffen the first and second body plates 20 and 26. As shown in FIGS. 2-10, the first plate 20 is also embossed around the fastener opening 82 in the first plate 20 in order to bring it level with the external surface 16 of the middle web 12 of the bridging member 11.

Typically, the elongated opening 8 in the central web 3 of the wall stud 2 has an edge 65 with a first elongated portion 66 and a second elongated portion 67, which are mutually parallel and vertically-oriented, a first concave portion 68 that joins the first and second elongated portions 66 and 67 at the top of the elongated opening 8, and a second concave portion 69 that joins the first and second elongated portions 66 and 67 at the bottom of the elongated opening 8, opposite the first concave portion 68. This shape is variously referred to as obround, a racetrack, and super-oval when the concave portions 68 and 69 are generally semicircular.

The substantially horizontal bridging member 11 typically has a middle web 12, a first boundary flange 17 and a second boundary flange 18. The bridging member 11 preferably is a continuous elongated member that extends through a plurality of openings 8 in a plurality of wall studs 2. The middle web 12 has a first boundary 13 and a second boundary 14, an internal surface 15 and an external surface 16. The first boundary flange 17 is joined to the first boundary 13, and the first boundary flange 17 has an internal surface 71 and an external surface 72. The second boundary flange 18 is joined to the second boundary 14, and the second boundary flange 18 has an internal surface 73 and an external surface 74. The middle web 12 is typically rectangular and occupies a horizontal plane. The first and a second boundary flanges 17 and 19 are typically rectangular and occupy vertical planes that are mutually parallel and are both orthogonal to the middle web 12. The middle web 12 of the bridging member 11 is typically 1.5 inches wide. The bridging member 11 is preferably no wider than the opening 8 over the entire length of the bridging member 11. The first boundary flange 17 typically has a first outer edge 75, and the second boundary flange 18 typically has a second outer edge 76. As shown in FIGS. 1-4B, 12 and 16, these first and second outer edges 75 and 76 of the boundary flanges 75 and 76 of the bridging member 11 usually face downward. However, they can face upward and the bridging connector 19 can either be turned upside down with the bridging member 11 or it can be installed against the first and second outer edges 75 and 76 rather than against the external surface 16 of the middle web 12 of the bridging member 11, although this is not preferred.

Preferably, the bridging connector 19 has a first body plate 20 and a second body plate 26 joined by a neck 32. Preferably, the first body plate 20, the second body plate 26 and the neck 32 are all generally planar and occupy the same plane directly above or below the middle web 12 of the bridging member 11.

Figure 4B:
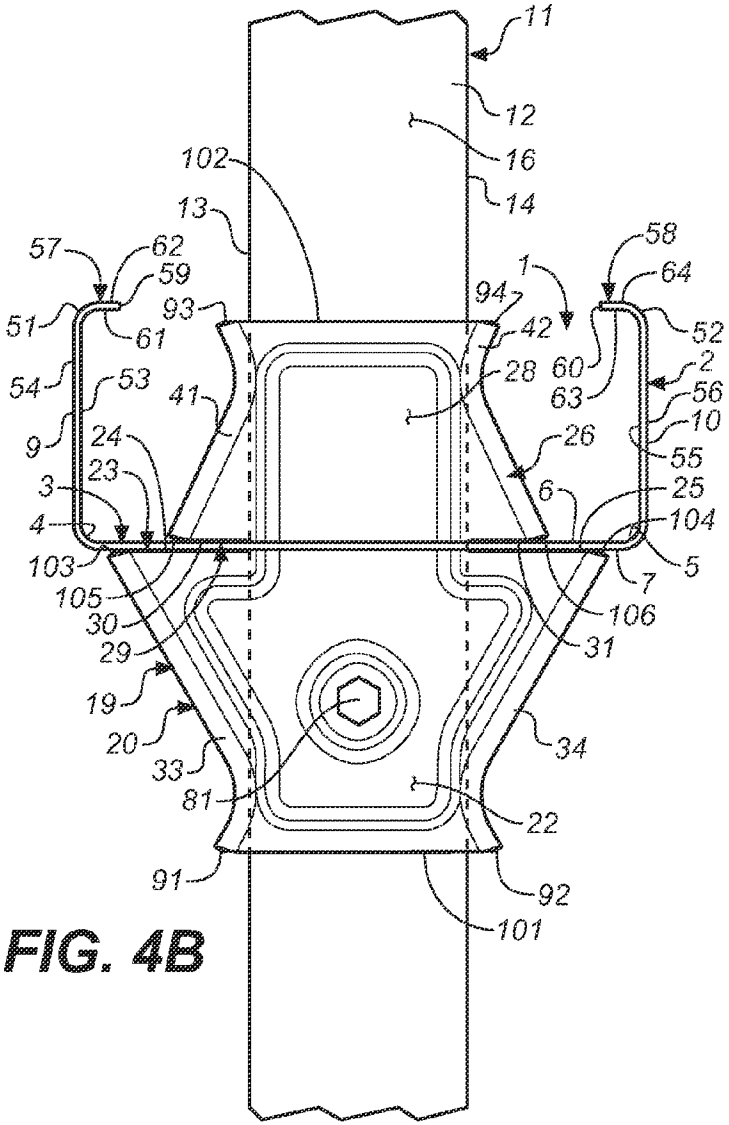
FIG. 4B is a top plan view of connection made between a typical cold-formed steel wall stud, a typical cold-formed steel bridging member, and the preferred form of the bridging connector of the present invention.
Figure 4A:
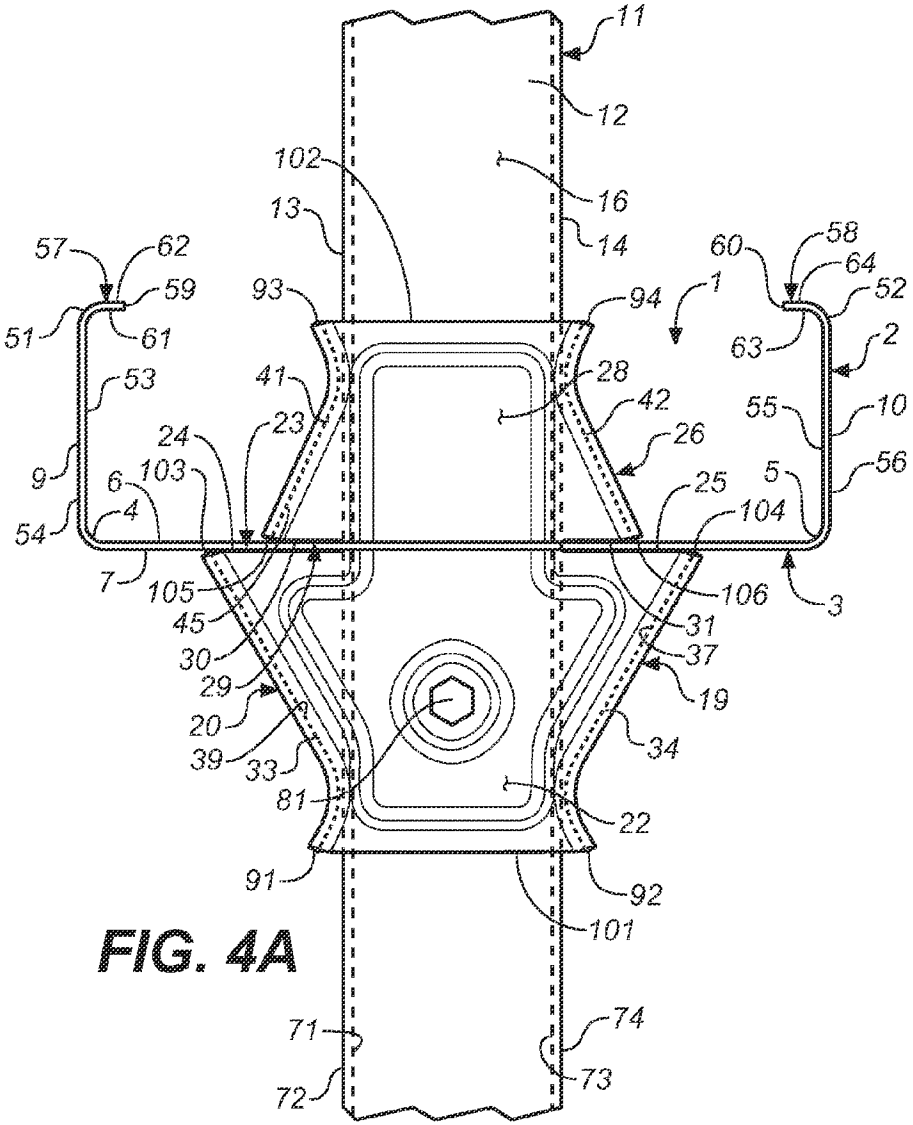
FIG. 4A is a top plan view of a connection made between a typical cold-formed steel wall stud, a typical cold-formed steel bridging member, and the preferred form of the bridging connector of the present invention, showing the portion of the bridging member below the bridging connector, the inner surfaces of the boundary flanges of the bridging connector, and the inner surfaces of the side flanges of the bridging connector in phantom line.
Figure 5A:
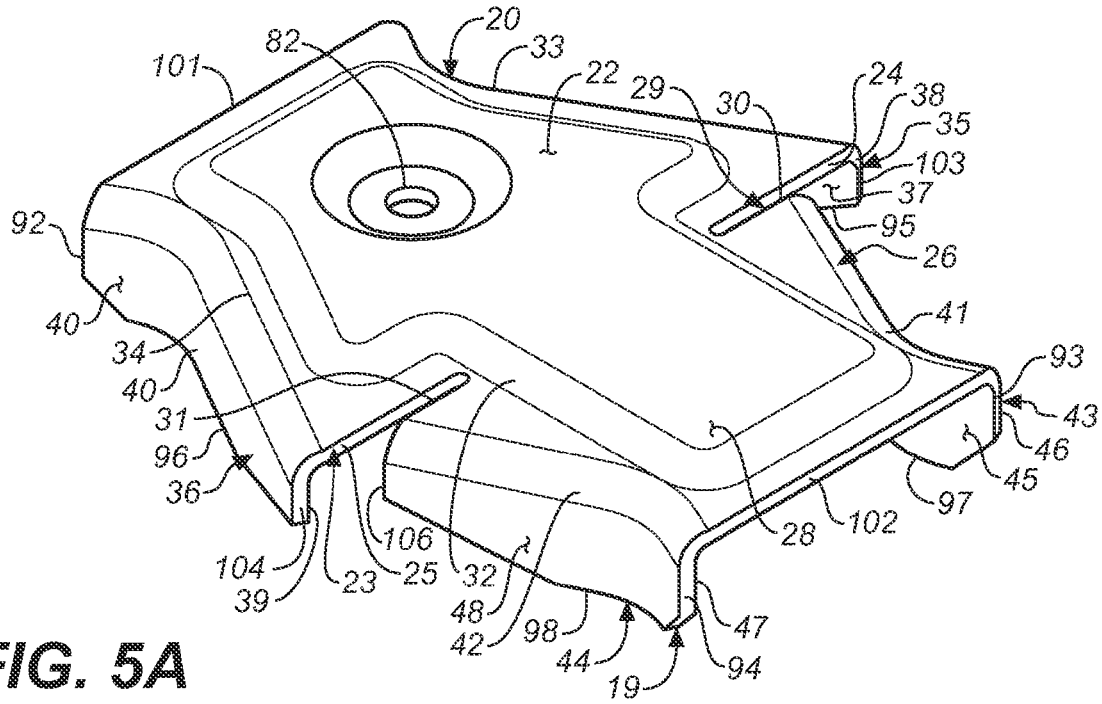
FIG. 5A is an upper rear left perspective view of the preferred form of the bridging connector of the present invention.
Figure 5B:
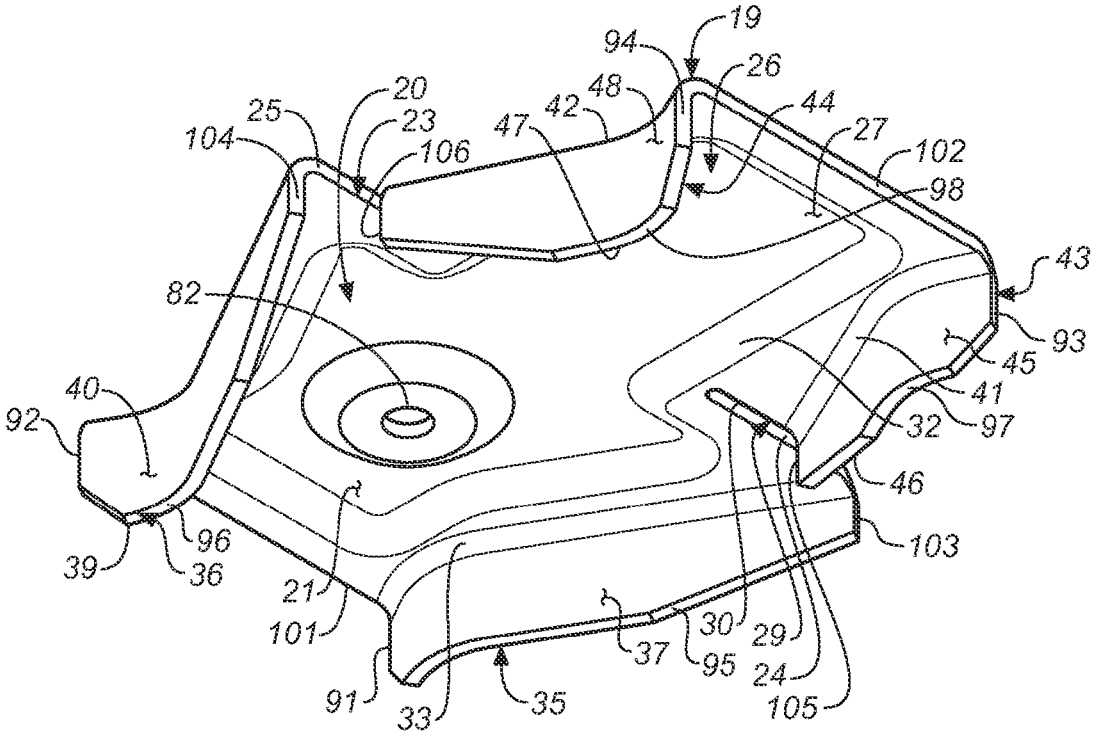
FIG. 5B is a lower rear left perspective view of the preferred form of the bridging connector of the present invention.
Figure 6:
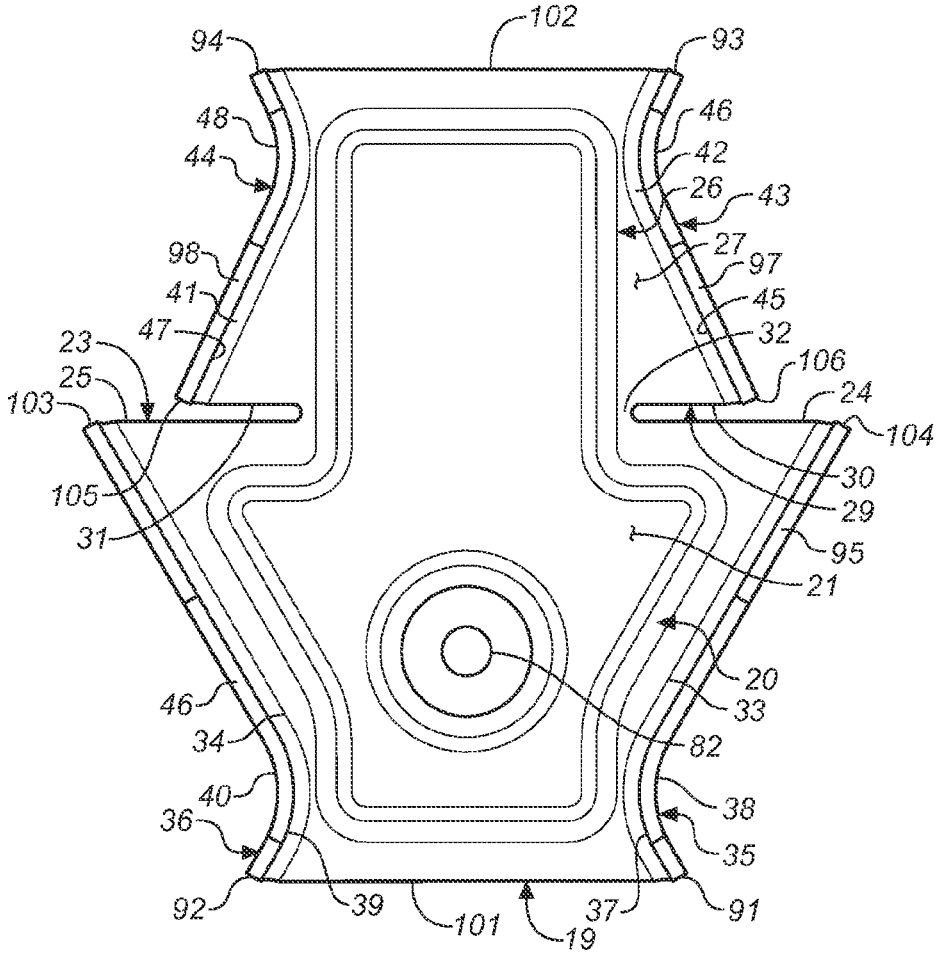
FIG. 6 is a bottom plan view of the preferred form of the bridging connector of the present invention.
Figure 8:
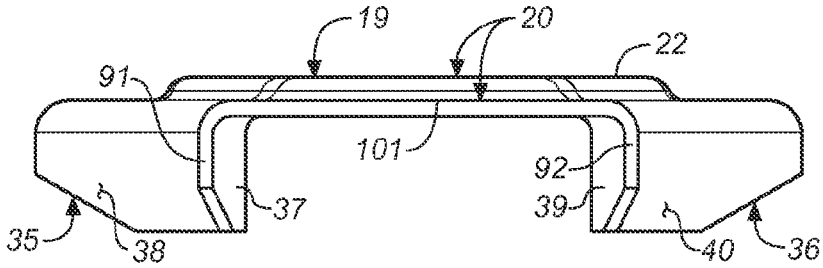
FIG. 8 is a rear elevation view of the preferred form of the bridging connector of the present invention.
Figure 10:
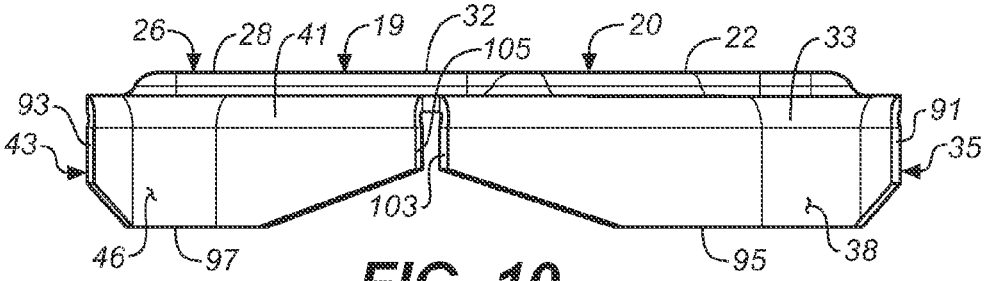
FIG. 10 is a left side elevation view of the preferred form of the bridging connector of the present invention.
Figure 7:
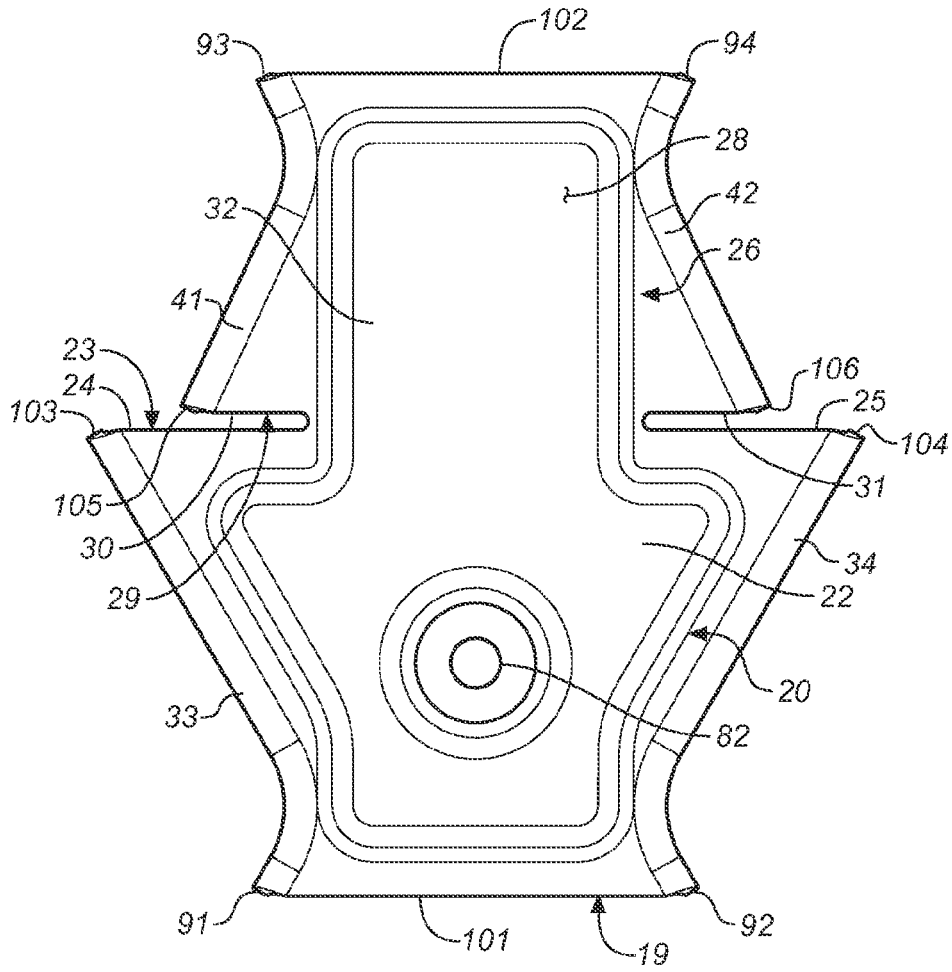
FIG. 7 is a top plan view of the preferred form of the bridging connector of the present invention.
Figure 9:
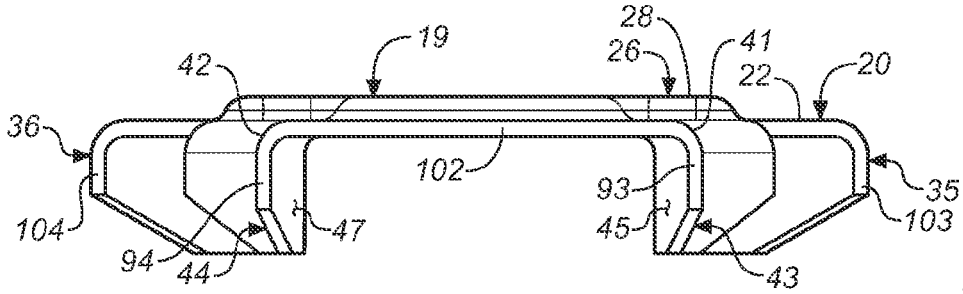
FIG. 9 is a front elevation view of the preferred form of the bridging connector of the present invention.
Figure 11A:
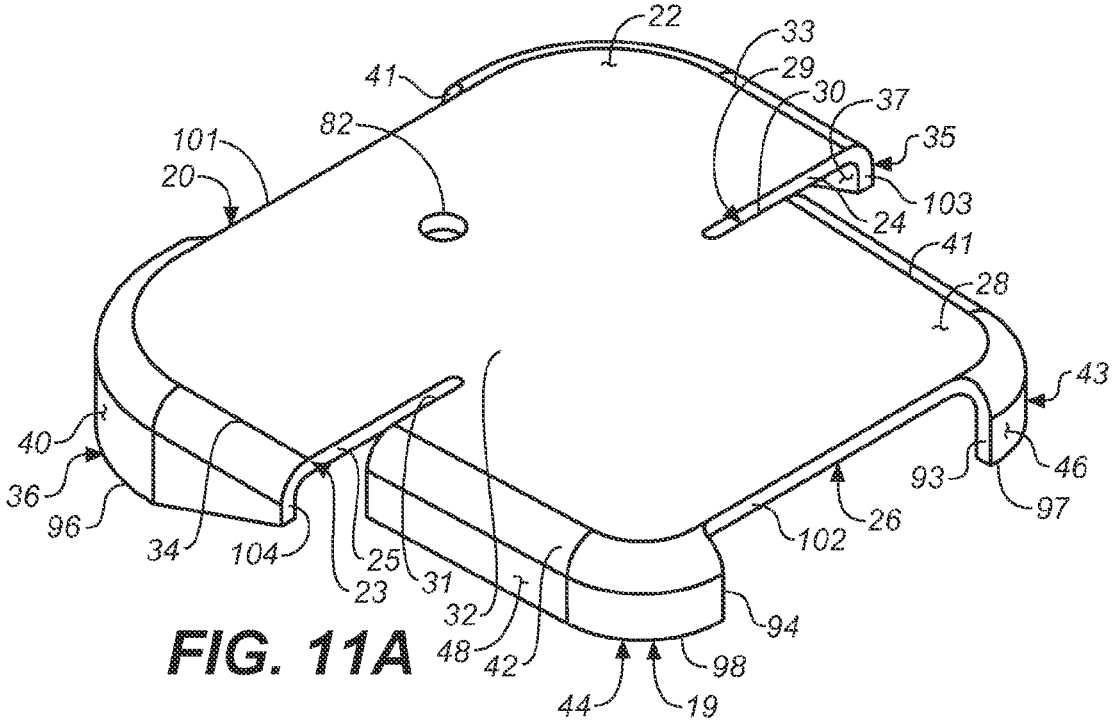
FIG. 11A is an upper rear left perspective view of a first alternate form of the bridging connector of the present invention.
Figure 11B:
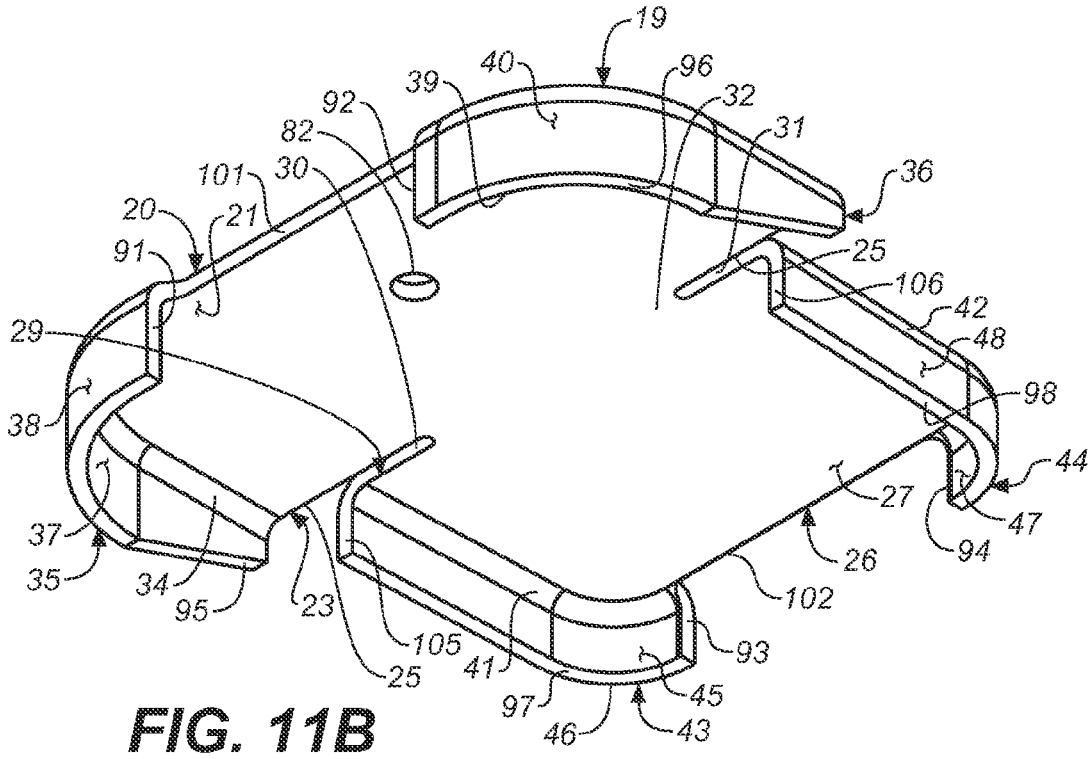
FIG. 11B is a lower front left perspective view of the first alternate form of the bridging connector of the present invention.
Figure 12:
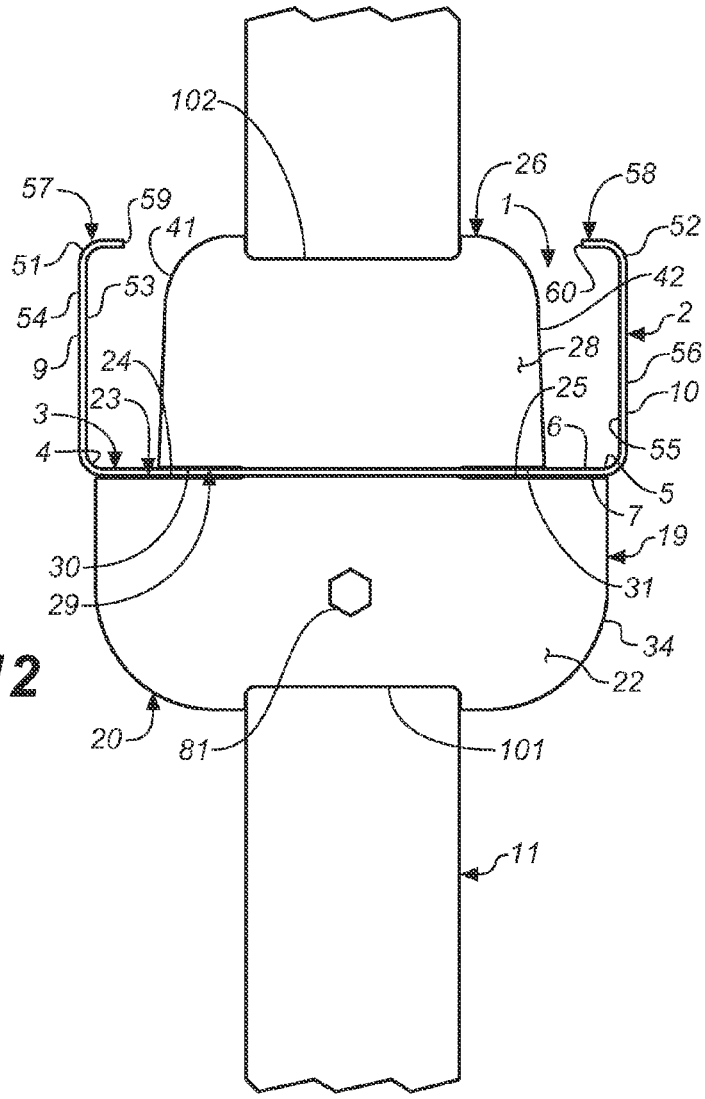
FIG. 12 is a top plan view of connection made between a typical cold-formed steel wall stud, a typical cold-formed steel bridging member, and the first alternate form of the bridging connector of the present invention.
Figure 13:
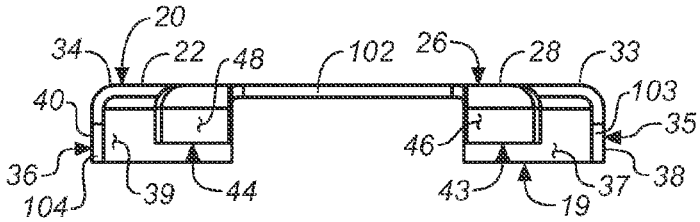
FIG. 13 is a rear elevation view of the first alternate form of the bridging connector of the present invention.
Figure 14:
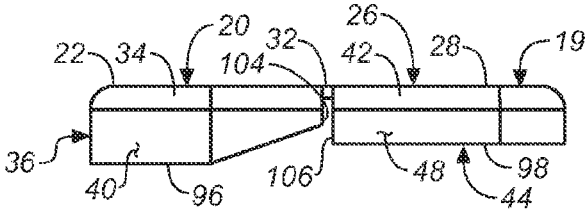
FIG. 14 is a right side elevation view of the first alternate form of the bridging connector of the present invention.
Figure 15A:
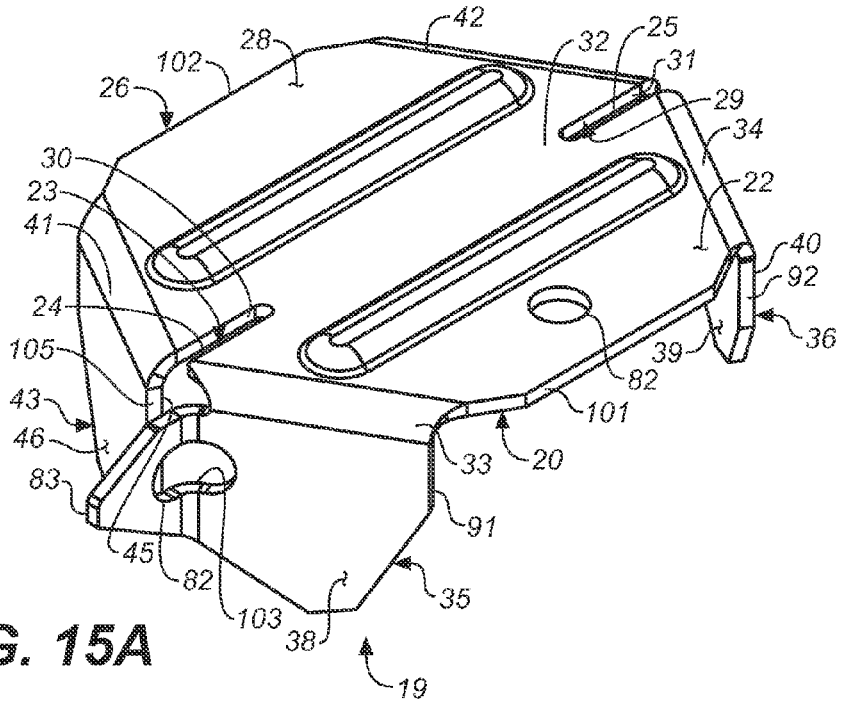
FIG. 15A is an upper front left perspective view of a second alternate form of the bridging connector of the present invention.
Figure 15B:
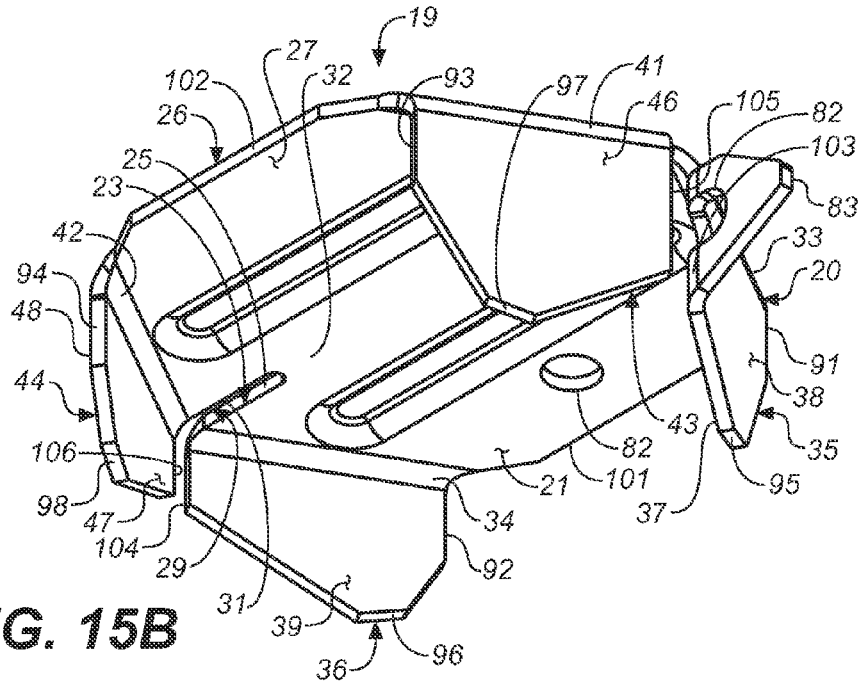
FIG. 15B is a lower rear right perspective view of the second alternate form of the bridging connector of the present invention.
Figure 16:
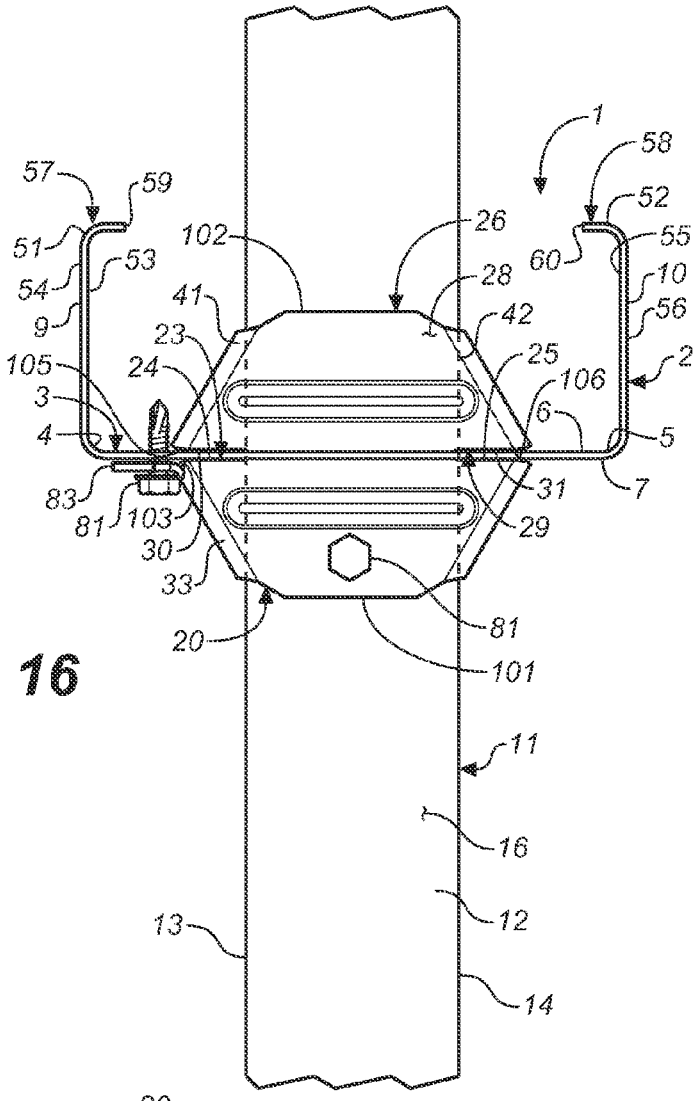
FIG. 16 is a top plan view of connection made between a typical cold-formed steel wall stud, a typical cold-formed steel bridging member, and the second alternate form of the bridging connector of the present invention.
Figure 17:
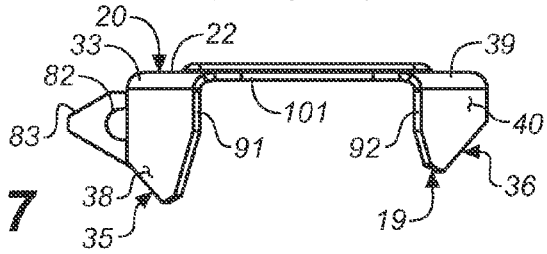
FIG. 17 is a front elevation view of the second alternate form of the bridging connector of the present invention.
Figure 18:
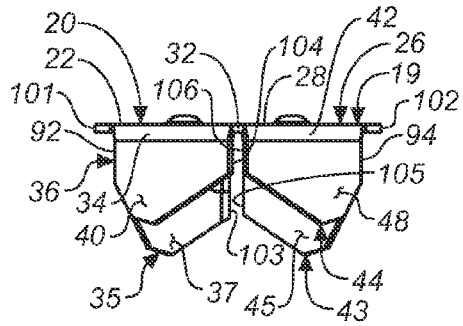
FIG. 18 is a right side elevation view of the first alternate form of the bridging connector of the present invention.

As shown in FIGS. 5A and 5B, the first body plate 20 preferably has a first interior surface 21 that faces the bridging member 11, a first exterior surface 22 opposite the first interior surface 11, and a first inner edge 23 with a first web interface portion 24 and a second web interface portion 25. The first inner edge 23 is preferably bounded by the first interior surface 21 and the first exterior surface 22 proximate the first inner edge 23. The second body plate 26 preferably has a second interior surface 27 that faces the bridging member 11, a second exterior surface 28 opposite the second interior surface 11, and a second inner edge 29 with a third web interface portion 30 and a fourth web interface portion 31. The second inner edge 29 is preferably bounded by the second interior surface 27 and the second exterior surface 28 proximate the second inner edge 29. Preferably, the first body plate 20 has a first outer edge 101 opposite the first inner edge 23, and the second body plate 26 has a second outer edge 102 opposite the second inner edge 29. Preferably, the first and second inner edges 23 and 29 are parallel to each other and are at least partially parallel to the first and second outer edges 101 and 102. Preferably, the first and second inner edges 23 and 29 are substantially opposed. The first and second inner edges 23 and 29 preferably lie in the same plane. Preferably, the first and second inner edges 23 and 29 occupy the same plane as the first and second body plates 20 and 26. The first and second body plates 20 and 26 preferably brace the first and second inner edges 23 and 29 against the central web 3 of the wall stud 2. Preferably, the effective depth of the member of the bridging connector 19 bracing central web 3 of the wall stud 2 is the effective length of the first and second body plates 20 and 26. In the most preferred embodiment, shown in FIGS. 2-10, the first body plate 20 preferably is 2 inches across, measured from the first inner edge 23 to the first outer edge 101. In the same embodiment, the second body plate 26 preferably is 1.5 inches across, measure from the second inner edge 29 to the second outer edge 102. This dimension allows the second body plate 26 to fit within the space bounded by the first and second side flanges 9 and 10 of the wall stud 2, which are typically 1.62 (1⅝) inches wide, as shown in FIGS. 4A and 4B. This allows two walls studs 2 to be "ganged" together in the same orientation without interference from the second body plate 26.

The neck 32 preferably is disposed between the first inner edge 23 and the second inner edge 29 between the first web interface portion 24 and the second web interface portion 25 of the first inner edge 23 and between the third web interface portion 30 and the fourth web interface portion 31 of the second inner edge 29.

Preferably, the interface portions 24, 25, 30 and 31 are always in contact with the central web 3 of the wall stud 2, but they may, due to differences in the thickness of the central web 3 of different wall studs, and otherwise imperfect tolerances, be adjacent to the central web 3 of the wall stud 2 without always being in contact. This is true generally of such a connection 1, in which elements are often imperfect.

Preferably, the neck 32 passes through the elongated opening 8 in the central web 3 of the wall stud 2. The first web interface portion 24 and the second web interface portion 25 of the first inner edge 23 preferably interface with either the inner surface 6 or the outer surface 7 of the central web 3 of the wall stud 2. The third web interface portion 30 and the fourth web interface portion 31 of the second inner edge 29 preferably interface with the other of the inner surface 6 and the outer surface 7 of the central web 3 of the wall stud 2. The neck 32 is preferably 1.5 inches wide, matching the width of the typical elongate opening 8. Preferably, the first inner edge 23 of the most preferred embodiment, shown in FIGS. 2-10, is 3.25 inches wide.

Preferably, the first body plate 20 has a first side boundary 33 and a second side boundary 34. A first side flange 35 is preferably attached to the first side boundary 33 and a second side flange 36 is attached to the second side boundary 34. The bridging connector 19 is preferably made from sheet metal, preferably galvanized steel—the most preferred embodiment shown in FIGS. 2-10 is preferably 18 or 14 gauge—and the first and second side boundaries 33 and 34 are preferably bends in the material of the bridging connector 19. Preferably, the first side flange 35 has an inner surface 37 facing the bridging member 11 and an outer surface 38 opposite the inner surface 37. Preferably, the second side flange 36 has an inner surface 39 facing the bridging member 11 and an outer surface 40 opposite the inner surface 39. The first side flange 35 of the bridging connector 2 preferably interfaces with the first boundary flange 17 of the bridging member 11. The second side flange 36 of the bridging connector 2 preferably interfaces with the second boundary flange 18 of the bridging member 11. Preferably, the first side flange 35 of the bridging connector 2 and the first boundary flange 17 of the bridging member 11 are at least partially nonparallel. Preferably, the second side flange 36 of the bridging connector 2 and the second boundary flange 18 of the bridging member 11 are at least partially nonparallel. Preferably, an 18-gauge bridging connector 19 will have the first and second web interface portions 24 and 25 of the first inner edge 23 spaced from the third and fourth web interface portions 30 and 31, respectively, of the second inner edge 29 to accommodate wall stud 2 central web 3 thicknesses of 0.0329, 0.0428 and 0.0538 inches, inclusive. Preferably, a 14-gauge bridging connector 19 will have the first and second web interface portions 24 and 25 of the first inner edge 23 spaced from the third and fourth web interface portions 30 and 31, respectively, of the second inner edge 29 to accommodate wall stud 2 central web 3 thicknesses of 0.0538, 0.0677 and 0.0966 inches, inclusive.

Most preferably, as shown in FIGS. 2-10, the inner surface 37 of the first side flange 35 of the bridging connector 2 is curvilinear convex where the inner surface 37 of the first side flange 35 interfaces with the first boundary flange 17 of the bridging member 11. The inner surface 39 of the second side flange 36 of the bridging connector 2 is curvilinear convex where the inner surface 39 of the second side flange 36 interfaces with the second boundary flange 18 of the bridging member 11.

These limited interfaces between the first and second side flanges 35 and 36 and the first and second boundary flanges 17 and 18 of the bridging member 11 are critical to the performance of the bridging connector 19 of certain aspect of the present invention. The first and second side flanges 35 and 36 of the bridging connector 19 of the present invention angle away from the first and second boundary flanges 17 and 18 of the bridging member 11, so that the first and second side flanges 35 and 36 buttress the interfaces, creating much greater resistance to lateral movement of the bridging member 11 than if the first and second side flanges 35 and 36 were parallel to the first and second boundary flanges 17 and 18 of the bridging member 11. This strength is compounded by the curvilinear convex interfaces of the most preferred embodiment, shown in FIGS. 2-10, because it creates two portions of each of the first and second side flanges 35 and 36 that angle away from the first and second boundary flanges 17 and 18 of the bridging member 11, buttressing each interface in two directions.

Alternatively, the first side flange 35 preferably has a first outer end edge 91, and the first outer end edge 91 of the first side flange 35 interfaces with the first boundary flange 17 of the bridging member 11. In this alternative, the the second side flange 36 preferably has a second outer end edge 92, and the second outer end edge 92 interfaces with the second boundary flange 18 of the bridging member 11. This is shown in FIGS. 11A-14, illustrating a first alternative embodiment of the bridging connector 19 in which the first and second side flanges 35 and 36 make a right-angled turn to meet the first and second boundary flanges 17 and 18 at right angles. It is also shown in FIGS. 15A-18, illustrating a second alternative embodiment of the bridging connector 19 in which the first and second side flanges 35 and 36 are straight and meet the first and second boundary flanges 17 and 18 at acute angles. This braces the interfaces between the first and second side flanges 35 and 36 and the first and second boundary flanges 17 and 18 from one direction.

Preferably, the second body plate 26 has a third side boundary 41 and a fourth side boundary 42. A third side flange 43 is preferably attached to the third side boundary 41 and a fourth side flange 44 is preferably attached to the fourth side boundary 42. Preferably, the third side flange 43 has an inner surface 45 facing the bridging member 11 and an outer surface 46 opposite the inner surface 45. Preferably, the fourth side flange 42 has an inner surface 47 facing the bridging member 11 and an outer surface 48 opposite the inner surface 47. The third side flange 43 of the bridging connector 2 preferably interfaces with the first boundary flange 17 of the bridging member 11. The fourth side flange 44 of the bridging connector 2 preferably interfaces with the second boundary flange 18 of the bridging member 11. Preferably, the third side flange 43 of the bridging connector 2 and the first boundary flange 17 of the bridging member 11 are at least partially nonparallel. Preferably, the fourth side flange 44 of the bridging connector 2 and the second boundary flange 18 of the bridging member 11 are at least partially nonparallel. Typically, the first side flange 35 has a first lower edge 95, the second side flange 36 has a second lower edge 96, the third side flange 43 has a third lower edge 97, and the fourth side flange 44 has a fourth lower edge 98. The first, second, third and fourth lower edges 95, 96, 97 and 98 can have different contours, dictated in part by material conservation and, balancing that, strength.

Preferably, the inner surface 45 of the third side flange 43 of the bridging connector 2 is curvilinear convex where the inner surface 45 of the third side flange 43 interfaces with the first boundary flange 17 of the bridging member 11. The inner surface 47 of the fourth side flange 44 of the bridging connector 2 is curvilinear convex where the inner surface 47 of the fourth side flange 44 interfaces with the second boundary flange 18 of the bridging member 11.

As with the first body plate 20, these limited interfaces between the third and fourth side flanges 43 and 44 and the first and second boundary flanges 17 and 18 of the bridging member 11 are critical to the performance of the bridging connector 19 of certain aspects of the present invention. The third and fourth side flanges 43 and 44 of the bridging connector 19 of the present invention angle away from the first and second boundary flanges 17 and 18 of the bridging member 11, so that the third and fourth side flanges 43 and 44 buttress the interfaces, creating much greater resistance to lateral movement of the bridging member 11 than if the third and fourth side flanges 43 and 44 were parallel to the first and second boundary flanges 17 and 18 of the bridging member 11. This strength is compounded by the curvilinear convex interfaces of the most preferred embodiment, shown in FIGS. 2-10, because it creates two portions of each of the third and fourth side flanges 43 and 44 that angle away from the first and second boundary flanges 17 and 18 of the bridging member 11, buttressing each interface in two directions.

Alternatively, the third side flange 43 has a third outer end edge 93, and the third outer end edge 93 of the third side flange 43 interfaces with the first boundary flange 17 of the bridging member 11. The fourth side flange 44 preferably has a fourth outer end edge 94, and the fourth outer end edge 94 interfaces with the second boundary flange 18 of the bridging member 11. This is shown in FIGS. 11A-14, illustrating a first alternative embodiment of the bridging connector 19 in which the third and fourth side flanges 43 and 44 make a right-angled turn to meet the first and second boundary flanges 17 and 18 at right angles. It is also shown in FIGS. 15A-18, illustrating a second alternative embodiment of the bridging connector 19 in which the third and fourth side flanges 43 and 44 are straight and meet the first and second boundary flanges 17 and 18 at acute angles. This braces the interfaces between the third and fourth side flanges 43 and 44 and the first and second boundary flanges 17 and 18 from one direction. The first side flange 35 preferably has a first inner end edge 103 spaced apart from the first outer end edge 91. The second side flange 36 preferably has a first inner end edge 104 spaced apart from the first outer end edge 92. The third side flange 43 preferably has a first inner end edge 105 spaced apart from the first outer end edge 93. The fourth side flange 44 preferably has a first inner end edge 106 spaced apart from the first outer end edge 94. The inner edge edges 103, 104, 105 and 106 can be braced against the central web 3 of the wall stud 2, thereby tying the first and second boundary flanges 17 and 18 of the bridging member 11 to the central web 3 of the wall stud 2, mutually supporting each other though one or more of the first, second, third and fourth side flanges 35, 36, 43 and 44 of the bridging connector 19.

Preferably, the connection 1 of the present invention is formed according to the following steps. First, the bridging member 11 is preferably inserted through the elongated opening 8 in the central web 3 of the vertical wall stud 2. Preferably, the elongated opening 8 has an edge 65 with a first elongated portion 66, a second elongated portion 67 parallel to the first elongated portion 66, a first curvilinear concave portion 68 joining the first elongated portion 66 and the second elongated portion 67, and a second curvilinear concave portion 69 opposite the first curvilinear concave portion 68 and joining the first elongated portion 66 and the second elongated portion 67. The first boundary flange 17 of the bridging member 11 preferably interfaces with the first elongated portion 66 of the elongated opening 8. Preferably, the second boundary flange 18 of the bridging member 11 interfaces with the second elongated portion 67 of the elongated opening 8. Preferably, while it is being inserted, the bridging connector 19 is positioned so that the neck 32 of the bridging connector 19 is not orthogonal to the first and second elongated portions 66 and 67 of the elongated opening 8. The second body plate 26 of the bridging connector 19 is inserted through the elongated opening 8. Preferably, the bridging connector 19 is rotated so that the neck 32 is orthogonal to the first and second elongated portions 66 and 67 of the elongated opening 8, the first web interface portion 24 and a second web interface portion 25 of the first inner edge 23 interface with the central web 3 of the wall stud 2, and the third web interface portion 30 and the fourth web interface portion 31 of the second inner edge 29 interface with the central web 3 of the wall stud 2. The bridging connector 19 is preferably positioned so that the first body plate 20 and the second body plate 26 interface with the bridging member 11. Preferably, the the first body plate 20 is fastened to the bridging member 19.

In an slightly different formulation, the bridging connector 19 of the present invention preferably comprises a first body plate 20 with a first side flange 35 and a second side flange 36. Preferably, the first body plate 20 has a first interior surface 21 facing the bridging member 11, and a first exterior surface 22 opposite the first interior surface 11. The first body plate 20 preferably has a first side boundary 33 and a second side boundary 34. Preferably, the first side flange 35 is attached to the first side boundary 33 and a second side flange 36 is attached to the second side boundary 34. The first side flange 35 preferably has an inner surface 37 facing the bridging member 11 and an outer surface 38 opposite the inner surface 37. Preferably, the second side flange 36 has an inner surface 39 facing the bridging member 11 and an outer surface 40 opposite the inner surface 39. The first side flange 35 of the bridging connector 2 preferably interfaces with the first boundary flange 17 of the bridging member 11. Preferably, the second side flange 36 of the bridging connector 2 interfaces with the second boundary flange 18 of the bridging member 11. The first side flange 35 of the bridging connector 2 and the first boundary flange 17 of the bridging member 11 preferably are at least partially nonparallel. Preferably, the second side flange 36 of the bridging connector 2 and the second boundary flange 18 of the bridging member 11 are also at least partially nonparallel.

Preferably, the inner surface 37 of the first side flange 35 of the bridging connector 2 is curvilinear convex where the inner surface 37 of the first side flange 35 interfaces with the first boundary flange 17 of the bridging member 11. The inner surface 39 of the second side flange 26 of the bridging connector 2 preferably is curvilinear convex where the inner surface 39 of the second side flange 26 interfaces with the second boundary flange 18 of the bridging member 11.

Alternatively, the first side flange 35 has a first end edge 91, and the first end edge 91 of the first side flange 35 interfaces with the first boundary flange 17 of the bridging member 11. Preferably then the second side flange 36 has a second end edge 92, and the second end edge 92 interfaces with the second boundary flange 18 of the bridging member 11.

Preferably, the first body plate 20 has a first inner edge 23 with a first web interface portion 24 and a second web interface portion 25. The bridging connector 19 then preferably has a second body plate 26 joined to the first body plate 20 by a neck 32. The second body plate 26 preferably has a second interior surface 27 facing the bridging member 11, a second exterior surface 28 opposite the second interior surface 11, and a second inner edge 29 with a third web interface portion 30 and a fourth web interface portion 31. The neck 32 preferably joins the first inner edge 23 to the second inner edge 29 between the first web interface portion 24 and the second web interface portion 25 and between the third web interface portion 30 and the fourth web interface portion 31. Preferably, the neck 32 passes through the elongated opening 8 in the central web 3 of the wall stud 2. The first web interface portion 24 and a second web interface portion 25 of the first inner edge 23 preferably interface with the central web 3 of the wall stud 2. Preferably, the third web interface portion 30 and the fourth web interface portion 31 of the second inner edge 29 interface with the central web 3 of the wall stud 2.

The second body plate 26 preferably has a third side boundary 41 and a fourth side boundary 42. A third side flange 43 preferably is attached to the third side boundary 41 and a fourth side flange 44 is attached to the fourth side boundary 42. Preferably, the third side flange 43 has an inner surface 45 facing the bridging member 11 and an outer surface 46 opposite the inner surface 45. The fourth side flange 42 preferably has an inner surface 47 facing the bridging member 11 and an outer surface 48 opposite the inner surface 47. Preferably, the third side flange 43 of the bridging connector 2 interfaces with the first boundary flange 17 of the bridging member 11. The fourth side flange 44 of the bridging connector 2 preferably interfaces with the second boundary flange 18 of the bridging member 11. Preferably, the third side flange 43 of the bridging connector 2 and the first boundary flange 17 of the bridging member 11 are at least partially nonparallel. The fourth side flange 44 of the bridging connector 2 and the second boundary flange 18 of the bridging member 11 preferably are at least partially nonparallel.

Preferably, the third side flange 43 has a third end edge 93, and the third end edge 93 of the third side flange 43 interfaces with the first boundary flange 17 of the bridging member 11. Preferably, the fourth side flange 44 has a fourth end edge 94, and the fourth end edge 94 interfaces with the second boundary flange 18 of the bridging member 11.

The inner surface 45 of the third side flange 43 of the bridging connector 2 preferably is curvilinear convex where the inner surface 45 of the third side flange 43 interfaces with the first boundary flange 17 of the bridging member 11. The inner surface 47 of the fourth side flange 44 of the bridging connector 2 preferably is curvilinear convex where the inner surface 47 of the fourth side flange 44 interfaces with the second boundary flange 18 of the bridging member 11.

An alternative method of making the connection 1 of the present invention is to first place the first body plate 20 on the bridging member 11 adjacent the central web 3 of the wall stud 2. In this manner, a portion of the first side flange 35 of the bridging connector 2 is adjacent the first boundary flange 17 of the bridging member 11 and a portion of the second side flange 36 of the bridging connector 2 is adjacent the second boundary flange 18 of the bridging member 11. Then, the bridging connector 2 is fastened to the bridging member 11. In all cases, the preferred fasteners 81 are metal screws 81, as shown in FIGS. 2, 3C-4B, 12 and 16. However, any sufficiently strong fastener 81 can be used, including welds. When screws 81 are used, the bridging connector 2 is preferably formed with one or more fastener openings 82 sized to closely accommodate the selected screws 81. All forms of the bridging connector 19 of the present invention are shown with a single fastener opening 82 in the first body plate 20, and it is an advantage of the bridging connector 19 of the present invention that it can make a stronger connection 1 than the prior art brackets with a single fastener 81. The fastener opening 82 is in the first body plate 20, and the first body plate 20 is preferably installed against the outer surface 7 of the central web 3 of the wall stud 2, because it is easier to fasten the bridging connector 19 where it is not bounded by the first and second side flanges 9 and 10 of the wall stud 2. However, it is possible to have use additional fasteners 81 and have additional fastener openings 82 elsewhere on the bridging connector 20, such as the second body plate 26. It is also possible, where the width of the wall stud 2 is sufficient, to install the bridging connector 19 with the first body plate 20 against the inner surface 6 of the central web 3 of the wall stud 2, with the second body plate 26 against the outer surface 7. In the alternate embodiment shown in FIGS. 15A-18, an attachment tab 83 is joined to the first inner edge 103 of the first side flange 35 of the bridging connector 19. The attachment tab 83 interfaces with the outer surface 7 of the central web 3 of the wall stud 2. The attachment tab 83 has a fastener opening 82 and a fastener 81 passes through the fastener opening 82 in the attachment tab 83 and into the central web 3 of the wall stud 2. Other attachments, with or without separate fasteners 81, welds, or the like are possible between the bridging connector 19 and the wall stud 2, but it is desirable to use the minimum number of fasteners 81 because this saves time and material and related costs.

We claim:

1. A building connection (1) comprising:

a. a substantially vertical wall stud (2) comprising:

i. a central web (3) having a first side (4) and a second side (5), an inner surface (6) and an outer surface (7), and an elongated opening (8);

ii. a first side flange (9) integrally attached to the first side (4); and iii. a second side flange (10) integrally attached to the second side (5);

b. a substantially horizontal bridging member (11) comprising:

i. a middle web (12) having a first boundary (13) and a second boundary (14), an internal surface (15) and an external surface (16);

ii. a first boundary flange (17) joined to the first boundary(l3), the first boundary flange (17) having an internal surface (71) and an external surface (72); and iii. a second boundary flange (18) joined to the second boundary (14), the second boundary flange (18) having an internal surface (73) and an external surface (74);

c. a bridging connector (19) contacting the central web (3) of the wall stud (2) and fastened to the bridging member (11), the bridging connector (19) comprising:

i. a first body plate (20) having a first interior surface (21) facing the bridging member (11), and a first exterior surface (22) opposite the first interior surface (21); wherein:

(a) the first body plate (20) has a first side boundary (33) and a second side boundary (34);

(b) a first side flange (35) is attached to the first side boundary (33) and a second side flange (36) is attached to the second side boundary (34);

(c) the first side flange (35) has an inner surface (37) facing the bridging member (11) and an outer surface (38) opposite the inner surface (37);

(d) the second side flange (36) has an inner surface (39) facing the bridging member (11) and an outer surface (40) opposite the inner surface (39);

(e) the first side flange (35) of the bridging connector (19) interfaces with the first boundary flange (17) of the bridging member (11);

(f) the second side flange (36) of the bridging connector (19) interfaces with the second boundary flange (18) of the bridging member (11);

(g) at least a portion of the first side flange (35) of the bridging connector (19) is neither above nor below the middle web (12) of the bridging member (11) and is not parallel to the first boundary flange (17) of the bridging member; and (h) at least a portion of the second side flange (36) of the bridging connector (19) is neither above nor below the middle web (12) of the bridging member (11) and is not parallel to the second boundary flange (18) of the bridging member (11).

2. The building connection (1) of claim 1 wherein:

a. the first side flange (35) interfaces with the central web (3) of the wall stud (2) and with the first boundary flange (17) of the bridging member (11).

3. The building connection (1) of claim 2 wherein:

a. the second side flange (36) interfaces with the central web (3) of the wall stud (2) and with the second boundary flange (18) of the bridging member (11).

4. The building connection (1) of claim 3 wherein:

a. the first side flange (35) has a first end edge (91); and b. the first end edge (91) of the first side flange (35) interfaces with the first boundary flange (17) of the bridging member (11).

5. The building connection (1) of claim 4 wherein:

a. the second side flange (36) has a second end edge (92); and b. the second end edge (92) interfaces with the second boundary flange (18) of the bridging member (11).

6. The building connection (1) of claim 3 wherein:

a. the inner surface (37) of the first side flange (35) of the bridging connector (19) is curvilinear convex where the inner surface (37) of the first side flange (35) interfaces with the first boundary flange (17) of the bridging member (11).

7. The building connection (1) of claim 6 wherein:

a. the inner surface (39) of the second side flange (36) of the bridging connector (19) is curvilinear convex where the inner surface (39) of the second side flange (26) interfaces with the second boundary flange (18) of the bridging member (11).

8. The building connection (1) of claim 3 wherein:

a. the first body plate (20) has a first inner edge (23) with a first web interface portion (24) and a second web interface portion (25), the bridging connector (19) additionally comprising:

i. a second body plate (26) having a second interior surface (27) facing the bridging member (11), a second exterior surface (28) opposite the second interior surface (11), and a second inner edge (29) with a third web interface portion (30) and a fourth web interface portion (31); and ii. a neck (32) joining the first body plate (20) to the second body plate (26) between the first web interface portion (24) and the second web interface portion (25) of the first inner edge (23) and between the third web interface portion (30) and the fourth web interface portion (31) of the second inner edge (29); wherein:

(a) the neck (32) passes through the elongated opening (8) in the central web (3) of the wall stud (2);

(b) the first web interface portion (24) and the second web interface portion (25) of the first inner edge (23) interface with the central web (3) of the wall stud (2);

(c) the third web interface portion (30) and the fourth web interface portion (31) of the second inner edge (29) interface with the central web (3) of the wall stud (2).

9. The building connection (1) of claim 8 wherein:

a. the second body plate (26) has a third side boundary (41) and a fourth side boundary (42);

b. a third side flange (43) is attached to the third side boundary (41) and a fourth side flange (44) is attached to the fourth side boundary (42);

c. the third side flange (43) has an inner surface (45) facing the bridging member (11) and an outer surface (46) opposite the inner surface (45);

d. the fourth side flange (42) has an inner surface (47) facing the bridging member (11) and an outer surface (48) opposite the inner surface (47);

e. the third side flange (43) of the bridging connector (19) interfaces with the first boundary flange (17) of the bridging member (11);

f. the fourth side flange (44) of the bridging connector (19) interfaces with the second boundary flange (l8) of the bridging member (11);

g. the third side flange (43) of the bridging connector (19) and the first boundary flange (17) of the bridging member (11) are at least partially nonparallel;

h. the fourth side flange (44) of the bridging connector (19) and the second boundary flange (18) of the bridging member (11) are at least partially nonparallel.

10. The building connection (1) of claim 9 wherein:

a. the third side flange (43) has a third end edge (93); and b. the third end edge (93) of the third side flange (43) interfaces with the first boundary flange (17) of the bridging member (11).

11. The building connection (1) of claim 10 wherein:

a. the fourth side flange (44) has a fourth end edge (94); and b. the fourth end edge (94) interfaces with the second boundary flange (18) of the bridging member (11).

12. The building connection (1) of claim 9 wherein:

a. the inner surface (45) of the third side flange (43) of the bridging connector (19) is curvilinear convex where the inner surface (45) of the third side flange (43) interfaces with the first boundary flange (17) of the bridging member (11).

13. The building connection (1) of claim 12 wherein:

a. the inner surface (47) of the fourth side flange (44) of the bridging connector (19) is curvilinear convex where the inner surface (47) of the fourth side flange (44) interfaces with the second boundary flange (18) of the bridging member (11).

14. A method of making the connection (1) of claim 3 comprising the steps of:

a. placing the first body plate (20) on the bridging member (11) adjacent the central web (3) of the wall stud (2) so that a portion of the first side flange (35) of the bridging connector (19) is adjacent the first boundary flange (17) of the bridging member (11) and a portion of the second side flange (36) of the bridging connector (19) is adjacent the second boundary flange (18) of the bridging member (11);

b. fastening the bridging connector (2) to the bridging member (11).

15. The building connection (1) of claim 1 wherein:

a. the bridging connector (19) is fastened to the bridging member (11) with a single fastener (81).

16. The building connection (1) of claim 15 wherein:

a. the first side flange (35) has a first end edge (91); and b. the first end edge (91) interfaces with the first boundary flange (17) of the bridging member (11).

17. The building connection (1) of claim 16 wherein:

a. the second side flange (36) has a second end edge (92); and b. the second end edge (92) interfaces with the second boundary flange (18) of the bridging member (11).

18. The building connection (1) of claim 15 wherein:

a. the inner surface (37) of the first side flange (35) of the bridging connector (19) is curvilinear convex where the inner surface (37) of the first side flange (35) interfaces with the first boundary flange (17) of the bridging member (11).

19. The building connection (1) of claim 17 wherein:

a. the inner surface (39) of the second side flange (36) of the bridging connector (19) is curvilinear convex where the inner surface (39) of the second side flange (26) interfaces with the second boundary flange (18) of the bridging member (11).

20. The building connection (1) of claim 15 wherein:

a. the first body plate (20) has a first inner edge (23) with a first web interface portion (24) and a second web interface portion (25), the bridging connector (19) additionally comprising:

i. a second body plate (26) having a second interior surface (27) facing the bridging member (11), a second exterior surface (28) opposite the second interior surface (11), and a second inner edge (29) with a third web interface portion (30) and a fourth web interface portion (31); and ii. a neck (32) joining the first body plate (20) to the second body plate (26) between the first web interface portion (24) and the second web interface portion (25) of the first inner edge (23) and between the third web interface portion (30) and the fourth web interface portion (31) of the second inner edge (29); wherein:

(a) the neck (32) passes through the elongated opening (8) in the central web (3) of the wall stud (2);

(b) the first web interface portion (24) and the second web interface portion (25) of the first inner edge (23) interface with the central web (3) of the wall stud (2);

(c) the third web interface portion (30) and the fourth web interface portion (31) of the second inner edge (29) interface with the central web (3) of the wall stud (2).

21. The building connection (1) of claim 20 wherein:

a. the second body plate (26) has a third side boundary (41) and a fourth side boundary (42);

b. a third side flange (43) is attached to the third side boundary (41) and a fourth side flange (44) is attached to the fourth side boundary (42);

c. the third side flange (43) has an inner surface (45) facing the bridging member (11) and an outer surface (46) opposite the inner surface (45);

d. the fourth side flange (42) has an inner surface (47) facing the bridging member (11) and an outer surface (48) opposite the inner surface (47);

e. the third side flange (43) of the bridging connector (19) interfaces with the first boundary flange (17) of the bridging member (11);

f. the fourth side flange (44) of the bridging connector (19) interfaces with the second boundary flange (l8) of the bridging member (11);

g. the third side flange (43) of the bridging connector (19) and the first boundary flange (17) of the bridging member (11) are at least partially nonparallel;

h. the fourth side flange (44) of the bridging connector (19) and the second boundary flange (18) of the bridging member (11) are at least partially nonparallel.

22. The building connection (1) of claim 21 wherein:

a. the third side flange (43) has a third end edge (93); and b. the third end edge (93) of the third side flange (43) interfaces with the first boundary flange (l7) of the bridging member (11).

23. The building connection (1) of claim 22 wherein:

a. the fourth side flange (44) has a fourth end edge (94); and b. the fourth end edge (94) interfaces with the second boundary flange (18) of the bridging member (11).

24. The building connection (1) of claim 21 wherein:

a. the inner surface (45) of the third side flange (43) of the bridging connector (19) is curvilinear convex where the inner surface (45) of the third side flange (43) interfaces with the first boundary flange (17) of the bridging member (11).

25. The building connection (1) of claim 24 wherein:

a. the inner surface (47) of the fourth side flange (44) of the bridging connector (19) is curvilinear convex where the inner surface (47) of the fourth side flange (44) interfaces with the second boundary flange (18) of the bridging member (11).

26. A method of making the connection (1) of claim 15 comprising the steps of:

a. placing the first body plate (20) on the bridging member (11) adjacent the central web (3) of the wall stud (2) so that a portion of the first side flange (35) of the bridging connector (19) is adjacent the first boundary flange (17) of the bridging member (11) and a portion of the second side flange (36) of the bridging connector (19) is adjacent the second boundary flange (18) of the bridging member (11);

b. fastening the bridging connector (2) to the bridging member (11).

27. The building connection (1) of claim 1 wherein:

a. the first body plate (20) is embossed for increased stiffness.

28. The building connection (1) of claim 8 wherein:

b. the second body plate (26) is embossed for increased stiffness.

* * * * *